US005478367A

United States Patent [19]

Sexton et al.

[11] Patent Number: 5,478,367

[45] Date of Patent: Dec. 26, 1995

[54] FUEL OIL COMPOSITIONS

[75] Inventors: Michael D. Sexton, Didcot; Anthony K. Smith, Reading, both of England; Antonio Gutierrez, Mercerville; Stanley J. Brois, Westfield, both of N.J.

[73] Assignee: Exxon Chemical Patents Inc., Linden, N.J.

[21] Appl. No.: 937,908

[22] PCT Filed: Oct. 11, 1991

[86] PCT No.: PCT/EP91/01937

§ 371 Date: Dec. 9, 1992

§ 102(e) Date: Dec. 9, 1992

[51] Int. Cl.[6] ..... C10L 1/22

[52] U.S. Cl. ..... 44/335; 44/338; 44/342; 44/344; 44/432; 44/433

[58] Field of Search ..... 44/335, 338, 342, 44/344, 432, 433

[56] References Cited

U.S. PATENT DOCUMENTS

| | | | |
|---|---|---|---|
| 2,402,427 | 6/1946 | Miller et al. | 44/335 |
| 3,018,250 | 1/1962 | Anderson et al. | 252/51.5 |
| 3,024,195 | 3/1962 | Drummond et al. | 252/51.5 |
| 3,438,757 | 4/1969 | Honnen et al. | 44/58 |
| 3,565,804 | 2/1971 | Honnen et al. | 252/50 |
| 3,574,576 | 4/1971 | Honnen et al. | 44/72 |
| 3,671,511 | 6/1972 | Honnen et al. | 260/93.7 |
| 3,898,056 | 8/1975 | Honnen et al. | 44/58 |
| 3,960,515 | 6/1976 | Honnen et al. | 44/58 |
| 4,022,589 | 5/1977 | Alquist et al. | 44/432 |
| 4,460,381 | 7/1984 | Karol et al. | 44/335 |
| 4,648,885 | 3/1987 | Reid | 44/335 |
| 4,637,886 | 1/1987 | Brois et al. | 252/51.5 A |
| 4,678,479 | 7/1987 | Holmes et al. | 44/432 |

FOREIGN PATENT DOCUMENTS

| | | |
|---|---|---|
| 0113582 | 12/1983 | European Pat. Off. . |
| 0203692 | 12/1986 | European Pat. Off. . |
| 0230783 | 8/1987 | European Pat. Off. . |
| 1254338 | 11/1971 | United Kingdom . |
| 1398067 | 6/1975 | United Kingdom . |

*Primary Examiner*—Jacqueline V. Howard
*Attorney, Agent, or Firm*—J. J. Mahon

[57] ABSTRACT

The addition to diesel or jet fuel of macrocyclic polyamines, especially those derived from PIBSA, or hydrocarbyl polyamines reduces particle emission, especially in association with organic nitrate cetane improvers.

13 Claims, No Drawings

FUEL OIL COMPOSITIONS

This invention relates to fuel oil compositions, and to additives for use in such compositions. More especially it relates to diesel, heating, and jet fuel oil compositions, and to reduction of particulate emissions on combustion.

Although modern internal combustion engines are highly efficient and give almost complete combustion of the hydrocarbon fuel used, the slight reduction from total efficiency leads to the formation of black smoke, a proportion of which is particulate carbon. Apart from the smoke's being unpleasant to breathe and unsightly, the carbon particles may have absorbed in them polynuclear hydrocarbons, which also result from incomplete combustion, some of which are known carcinogens.

It has been previously proposed to use certain additives to reduce smoke. These additives, which are based on metal salts, reduce smoke at the expense of increasing particulate emission, because the additive is emitted in the form of oxide or sulphate which contributes to the mass of particulates in the exhaust.

There remains a need for an emission-reducing additive for diesel and jet fuel that is itself metal-free and combustible without contributing to the weight of particulates emitted.

In EP-A-203692, there is disclosed as a fuel oil additive a composition comprising a macrocyclic polyamine dispersant and a polyphenol, a sulphurized phenol or a hindered phenol. The composition is said to impart storage stability to the fuel oil, and to reduce the coking of fuel injector nozzles when the fuel is used as a diesel fuel. In Example 4 of the application, the macrocyclic derivative of a polyisobutenyl succinic anhydride (MW 1300) and pentapropylene hexamine is shown to reduce injector nozzle fouling when used alone. Injector nozzle fouling is normally accompanied by an increase in particulate emissions.

The present invention is based on the observation that certain dispersants, if desired in combination with cetane enhancers, when incorporated in a diesel, heating, or jet fuel, reduce the emission of particulates on combustion of the fuel even in the absence of injector deposits.

In its broadest aspect, therefore, the present invention provides the use of an ashless oil soluble macrocyclic polyamine dispersant to reduce particulate emission in the combustion of a fuel oil, other than the particulate emission reduction resulting from a reduction in injector nozzle fouling in a diesel engine, reduction in fouling including both the removal of existing injector nozzle deposits and the inhibition of deposit formation.

The reduction in particulate emission achieved by the present invention results directly on combustion of a fuel containing the macrocyclic dispersant, compared with the emissions resulting from combustion, in the same combustion chamber with the same conditions upstream of the combustion chamber, of fuel not containing the dispersant but otherwise identical. The reduction achieved by the present invention is herein referred to as the "direct" reduction.

While the applicants do not wish to be bound by any theory, it is believed that under given conditions (which include any deposits present in injectors or elsewhere upstream of the combustion chamber) the presence of the macrocylic dispersant in the fuel, or in the fuel/air mixture, in the combustion chamber results in an improvement in the quality of combustion, as measured by completeness of oxidation. This improvement may in turn be the result of a change in the physical properties of the fuel, or the fuel/air mixture, e.g., the surface tension of the fuel, resulting in improved mixing and reduced soot and smoke formation. The reference above to the presence of the dispersant includes the presence of a reaction product of the dispersant with a component of the fuel, the reaction having taken place either before entry into the combustion chamber or within the combustion chamber prior to combustion.

More especially, the dispersant is one containing the group —N=C—N—C=O, of which the —N=C—N group forms part of a ring, and of which the carbon and nitrogen atoms of the C—N=C=O group form part of a different ring.

The present invention accordingly provides the use, as a particulate-reducing additive for, and the use in reducing particulate emission in the combustion of, a fuel oil of an oil soluble compound of the formula:

(I)

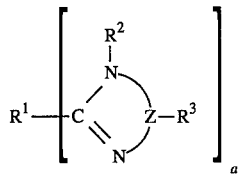

or $$R^6R^4NR^5[NR^4R^5]_bNR^4R^4 \quad \text{(II)}$$

or mixtures of two or more such compounds, wherein $R^1$, $R^2$ and $R^3$ may be the same or different and are independently hydrogen or a hydrocarbyl substituent having from 2 to 600 carbon atoms, or a keto, halo, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together form a hydrocarbylene substituent having 4 to 600 carbon atoms or a keto, halo, hydroxy, nitro, cyano or alkoxy derivative thereof, provided that $R^1$ and $R^2$ together with the carbon atom which forms the C—$R^1$ bond with $R^1$ and the nitrogen atom which forms the N—$R^2$ bond with $R^2$ form a ring having at least 5 members, wherein Z represents $$—R^{10}[NR^{11}(R^{10})]_c—$$

or $$—[R^{10}R^{11}N]_dR^{10}[NR^{11}R^{10}]_e$$

wherein each $R^{10}$, which may be the same or different, represents an alkylene group having from 1 to 5 carbon atoms in its chain each $R^{11}$, which may be the same or different, represents a hydrogen atom or a hydrocarbyl group, and c is from 0 to 6, d is from 1 to 4, e is from 1 to 4, provided that d+e is at most 5, each $R^4$ is independently H or an alkyl group having up to 5 carbon atoms, $R^5$ is an alkylene group having up to 6 carbon atoms in the chain, optionally substituted by one or more hydrocarbyl groups having up to 10 carbon atoms, an acyl group having from 2 to 10 carbon atoms, or a keto, halo, hydroxy, nitro, cyano or alkoxy derivative of a hydrocarbyl group having from 1 to 10 carbon atoms or of an acyl group having from 2 to 10 carbon atoms, $R^6$ is a hydrocarbyl substituent having from 2 to 600 carbon atoms or said derivative thereof, a is from 1 to 150, and b is from 0 to 12. Advantageously, when c is zero, there are at least two carbon atoms in the $R^{10}$ alkylene chain.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic- and alicyclic-substituted aromatic, and aromatic-substituted aliphatic and alicyclic groups. Aliphatic groups are advantageously saturated. Examples include methyl, ethyl, propyl, butyl, isobutyl, pentyl, hexyl, octyl, decyl, octadecyl, cyclohexyl, and phenyl. These groups may, as indicated above, contain non-hydrocarbon substituents provided they do not alter the predominantly hydrocarbon character of the group. Examples include keto, halo, hydroxy, nitro, cycano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, oxygen and sulfur. The term "hydrocarbylene" is used analogously; such a group is attached to the rest of the molecule at least at one end and preferably at both ends through a carbon atom.

Advantageously, there is used a compound of the formula:

III

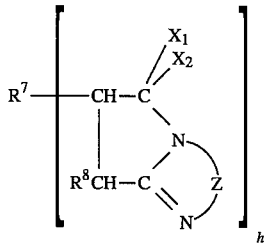

IV

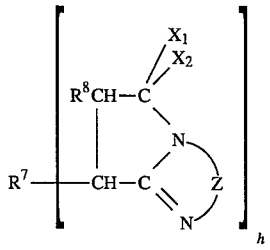

V

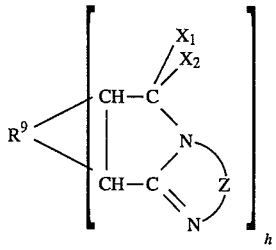

wherein $R^7$ is hydrogen or a hydrocarbyl substituent having from 1 to 600 carbon atoms, $R^8$ is hydrogen or a $C_1$ to $C_{12}$ hydrocarbyl substituent and, if there is more than one $R^8$ in a compound, they may be the same or different, $R^9$ is a hydrocarbylene substituent having from 2 to 600 carbon atoms, two of which carbon atoms are bonded to the α-carbon atoms of the succinic anhydride based ring, $X_1$ represents hydrogen or an alkyl group having from 1 to 12 carbon atoms, $X_2$ represents hydrogen, an alkyl group having from 1 to 12 carbon atoms, a hydroxy group, or an alkoxy group, having from 1 to 12 carbon atoms, or $X_1$ and $X_2$ may together represent an oxygen or sulphur atom, Z has the meaning given above, and h is from 1 to 20. Advantageously h represents 1.

Although in $R^{10}$ the alkylene chain may have at most 5 carbon atoms, it may be branched, and the length of the branch or branches is not limited. When $R^3$ represents a hydrocarbyl substituent, and Z contains a nitrogen atom, the hydrocarbyl substituent is advantageously linked to the, or a, nitrogen atom. The nitrogen-hydrocarbyl linkage may in that case be, e.g., an amide linkage.

Preferably there is used a macrocyclic polyamine compound of the formula:

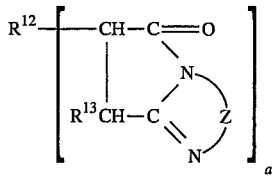

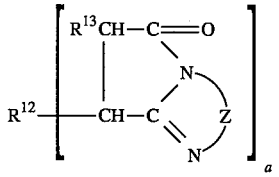

or

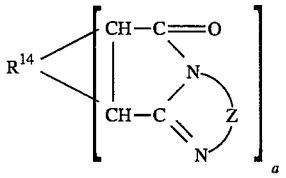

or mixtures of two or more such compounds, wherein $R^{12}$ is a hydrocarbyl substituent having from 2 to 400 carbon atoms, $R^{13}$ is hydrogen or a $C_1$ to $C_{12}$ hydrocarbyl substituent, $R^{14}$ is a hydrocarbylene substituent having from 4 to 400 carbon atoms, two of which carbon atoms are bonded to the α-carbon atoms of the succinic anhydride based ring, and Z represents $—CH_2CH_2CH_2—$; $—(CH_2CH_2CH_2NH)_nCH_2CH_2CH_2—$, where n is 1 to 6, or $—(CH_2CH_2CH_2NH)_m(CH_2)_p(NHCH_2CH_2CH_2)_q—$ where m and q are each at least 1 and m+q=2 to 5, p is 1 to 5, and a is 1 to 20.

The invention also provides a method of reducing particulate emission resulting from the combustion of a fuel oil, which comprises mixing a compound of the formula I or II, more especially a compound of the formula III, IV, or V, as defined above, with the fuel oil before burning the fuel oil. Also provided is a method of reducing particulate emission resulting from burning fuel oil, which comprises the combustion of a fuel oil containing an above-mentioned compound.

A method for the preparation of the macrocyclic polyamines of the formulae above is described, for example, in U.S. Pat. No. 4,637,886, the disclosure of which is incorporated by reference herein. Formation of the macrocyclic and optionally polymacrocyclic compounds proceeds by the aminolysis of hydrocarbyl succinic anhydride, monocarboxylic acid or polycarboxylic acid, adding the acid or anhydride to the di or polyamide compound, as described in more detail in the above-referenced U.S. patent.

The hydrocarbyl and hydrocarbylene substituents $R^{12}$ and $R^{14}$ are advantageously derived from a polymer based on a major amount of a $C_2$ to $C_5$ olefin, for example homo or copolymers of ethylene, propylene, butylene (1- or 2-), pentylene and, especially, isobutylene. Polyisobutylene is especially preferred. When the polymer is a copolymer, it may be a copolymer of two or more of the specified monomers, or a copolymer of one or more of the specified monomers with a copolymerizable unsaturated monomer; when the polymer is a copolymer it may be a block or a random copolymer.

The polymer advantageously has from 5 to 300 carbon atoms, preferably 10 to 200 carbon atoms and most preferably 20 to 100 carbon atoms. Preparation of the alkyl and alkenyl succinic anhydrides which form convenient reactants for the cyclodehydration reaction by which the macrocyclic polyamine may be produced is described, for example, in U.S. Pat. Nos. 3,018,250 and 3,024,195, the disclosures of which are incorporated by reference herein.

Suitable amine reactants are of the formula $NH_2$—Z—$NH_2$, where Z has the meaning given above. Preferred amines include 1,3-propane diamine; 3,3'-imino-bis-propylamine, N,N'-bis(3-aminopropyl)ethylene diamine; N,N'-bis(3-aminopropyl)-1,3-propane diamine; other suitable amines include ethylene diamine, diethylene triamine, triethylene tetramine, tetraethylene pentamine, pentamethylene hexamine, dipropylene triamine, tripropylene tetramine, tetrapropylene pentamine and pentapropylene hexamine.

The mole ratio of alkenyl or alkyl succinic anhydride to polyamine used in the preferred preparation of the macrocyclic polyamines may vary, for example, from 0.2:1 to 5:1, and is preferably from 0.5:1 to 2:1, and most preferably from 0.5:1 to 1.5:1.

As monocarboxylic acid there may be used an acid of the formula:

$$R^{15}—COOH$$

where $R^{15}$ is hydrogen, or a substituted or unsubstituted alkyl, cycloalkyl, alkenyl, cycloalkenyl, or aryl group. Examples of such acids include formic acid, acetic acid, propionic acid, butyric acid, valeric acid, palmitic acid, stearic acid, cyclohexanecarboxylic acid, 2-methylcyclohexane carboxylic acid, 4-methylcyclohexane carboxylic acid, oleic acid, linoleic acid, linolenic acid, cyclohex-2-eneoic acid, benzoic acid, 2-methylbenzoic acid, 3-methylbenzoic acid, 4-methylbenzoic acid, salicylic acid, 2-hydroxy-4-methylbenzoic acid, 2-hydroxy-4-ethylsalicylic acid, p-hydroxybenzoic acid, 3,5-di-tert-butyl-4-hydroxybenzoic acid, o-aminobenzoic acid, p-aminobenzoic acid, o-methoxybenzoic acid and p-methoxybenzoic acid.

As dicarboxylic acid there may be used an acid of the formula:

$$HOOC—(CH_2)_t—COOH$$

where t is zero or an integer, including e.g. oxalic acid, malonic acid, succinic acid, glutaric acid, adipic acid, pimelic acid and suberic acid, or an acid of the formula:

$$HOOC—(CH_2)_x—\underset{}{\overset{R^{15}}{\overset{|}{CH}}}—(CH_2)_y—COOH$$

where t is zero or an integer, y is zero or an integer and x and y may be equal or different and $R^{15}$ is as defined above. Examples of such acids include the alkyl or alkenyl succinic acids, 2-methylbutanedioic acid, 2-ethylpentanedioic acid, 2-n-dodecylbutanedioic acid, 2-n-dodecenylbutanedioic acid, 2-phenylbutanedioic acid, and 2-(p-methylphenyl)butanedioic acid. Also included are polysubstituted alkyl dicarboxylic acids wherein other $R^{15}$ groups as described above may be substituted on the alkyl chain. These other groups may be substituted on the same carbon atom or different atoms. Such examples include 2,2-dimethylbutanedioic acid; 2,3-dimethylbutanedioic acid; 2,3,4-trimethylpentanedioic acid; 2,2,3-trimethylpentanedioic acid; and 2-ethyl-3-methylbutanedioic acid.

The dicarboxylic acids also include acids of the formula:

$$HOOC—(C_rH_{2r-2})COOH$$

where r is an integer of 2 or more. Examples include maleic acid, fumaric acid, pent-2-enedioic acid, hex-2-enedioic acid; hex-3-enedioic acid, 5-methylhex-2-enedioic acid; 2,3-di-methylpent-2-enedioic acid; 2-methylbut-2-enedioic acid; 2-dodecylbut-2-enedioic acid; and 2-polyisobutylbut-2-enedioic acid.

The dicarboxylic acids also include aromatic dicarboxylic acids e.g. phthalic acid, isophthalic acid, terephthalic acid and substituted phthalic acids of the formula:

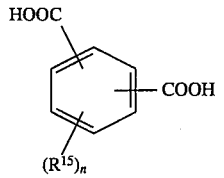

where $R^{15}$ is as defined above and n=1, 2, 3 or 4 and when n>1 then the R groups may be the same or different. Examples of such acids include 3-methylbenzene- 1,2-dicarboxylic acid; 4-phenylbenzene-1,3-dicarboxylic acid; 2-(1-propenyl)benzene-1,4-dicarboxylic acid, and 3,4-dimethylbenzene-1,2-dicarboxylic acid.

Advantageously the compound of the formula II is a compound of the formula:

$$R^{12}R^{13}N—(CR^{16}R^{17})_n—[NH(CR^{18}R^{19})_u]_b—NR^{13}R^{13}$$

in which in the or each such compound the $R^{13}$s may be the same or different, and in which $R^{12}$ and $R^{13}$ have the meanings given above, $R^{16}$, $R^{17}$, $R^{18}$, and $R^{19}$ are independently hydrogen, a hydrocarbyl group having from 1 to 10 carbon atoms, an acyl group having from 2 to 10 carbon atoms, or a monoketo, monohydroxy, mononitro, monocyano or alkoxy derivative of a hydrocarbyl group having from 1 to 10 carbon atoms or of an acyl group having from 2 to 10 carbon atoms, n is from 1 to 6, u is from 1 to 6, and b is from 0 to 12.

The preparation of such compounds is described for example in U.S. Pat. Nos. 3,438,757, 3,565,804, 3,574,576, 3,671,511, 3,898,056, and 3,960,515, and British Patents No. 1 254 338 and 1 398 067, the disclosures of which are incorporated herein by reference. In this embodiment, the preferred hydrocarbyl substituents represented by R are as given above with reference to the macrocyclic polyamines.

The polyamine used to derive the hydrocarbyl polyamine is advantageously a compound having from 2 to 12 nitrogen atoms and from 2 to 40 carbon atoms. The preferred hydrocarbyl polyamines for use in this invention are compounds derived from polyalkylene polyamines, including alkylene diamines and substituted polyalkylene polyamines. Preferably, the alkylene group contains from 2 to 6 carbon atoms, there being preferably from 2 to 3 carbon atoms between the nitrogen atoms. Examples of such polyamines include ethylene diamine, diethylene triamine, triethylene tetramine, tetraethylene pentamine, di(trimethylene)triamine, propylene diamine, dipropylene triamine, tripropylene tetramine, N-methyl ethylene diamine, N-N,-dimethyl ethylene diamine, N-methyl- 1,3-diamino propane and N,N-dimethyl-1,3-diamino propane. Such amines include branched chain polyamines and cyclic structures formed by reaction of linear polyamines. Among the polyalkylene polyamines those containing from 2 to 12 nitrogen atoms and from 2 to 24 carbon atoms are especially preferred.

The mole ratios of alkyl or alkenyl halide to polyamine, used in accordance with the preferred method of making the compounds, are as described above for the succinic anhydride/polyamine reaction.

In further embodiments of this invention, the additive used may be a derivative of the macrocyclic or hydrocarbyl polyamines described above, such derivative being one obtainable by, and preferably one obtained by, post-treatment with, for example, boron oxide, boron oxide hydrate, a boron halide, a boron acid, sulphur, a sulphur chloride, a phosphorus oxide or sulphide, a carboxylic acid or anhydride, an acyl halide, an epoxide, an episulphide or acrylonitrile. Methods for carrying out such treatment are well known in the art; for example boration to incorporate 0.1 to 1 atoms of boron for each nitrogen atom may be carried out as described in U.S. Pat. No. 3,254,025, the disclosure of which is incorporated by reference herein.

A preferred post-treatment for the formation of an additive is treatment with polyisobutylene succinic anhydride. Advantageously, the macrocyclic or hydrocarbyl polyamine is treated with 10 to 50 mole % of an anhydride formed from a polyisobutylene of molecular weight 900 to 1200. for example by reaction at 120° C. for an hour or until the reaction mixture contains no free anhydride.

In a third embodiment, accordingly, the invention provides the use as a particulate-reducing additive for, and the use in reducing particulate emission in the combustion of, a diesel or jet fuel of a post-treated macrocyclic or hydrocarbyl polyamine as defined above, especially one post treated with a polyisobutylene succinic anhydride.

The additives may be used either alone or in combination with other additives according to the invention or in combination with other fuel additives. Advantageously the concentration of the additive according to the invention in the fuel is in the range of from 0.0005 to 2, preferably from 0.001 to 0.5, and more preferably from 0.005 to 0.3%, based on the weight of the fuel.

The use of other additives does not adversely affect the performance of the macrocyclic compound. In some cases the use of another additive or additives may lead to a reduction in emissions greater than might be expected. Other additives which may be used include, for example, diesel detergents, antifoam additives, antirust additives, and demulsifiers. These other additives may be present in the fuel in a total concentration of 0.001 to 1, preferably 0.005 to 0.2, and most preferably a total concentration of 0.005 to 0.05%, based on the total weight of fuel.

A specific example of such a combination is the use of a macrocyclic compound with a detergent which is the uncyclized reaction product formed from a hydrocarbyl succinic anhydride and a polyamine. The detergent is advantageously present in a concentration of 0.005 to 0.1, preferably 0.005 to 0.5, and most preferably from 0.005 to 0.2%, based on the total weight of the fuel.

It has also been unexpectedly found that the use of a combination of one or more of the additives in accordance with the invention together with a cetane improver gives enhanced particulate emission reduction. Accordingly, the invention also provides such use.

Preferred cetane improvers are organic nitrates; there may also be used, for example, substituted triazoles and tetrazoles, for example those described in European Patent Application No. 230783, the disclosure of which is incorporated herein by reference. Preferred organic nitrates are nitrate esters containing aliphatic or cycloaliphatic groups with up to 30 carbon atoms, preferably saturated groups, and preferably with up to 12 carbon atoms. As examples of such nitrates, there may be mentioned methyl, ethyl, propyl, isopropyl, butyl, amyl, hexyl, heptyl, octyl, iso-octyl, 2-ethylhexyl, nonyl, decyl, allyl, cyclopentyl, cyclohexyl, methylcyclohexyl, cyclododecyl, 2-ethoxyethyl, and 2-(2-ethoxyethoxy) ethyl nitrates.

The cetane improver is advantageously used at a concentration in the fuel in the range of from 0.0005 to 1, preferably 0.005 to 0.5 and most preferably from 0.01 to 0.2%, based on the weight of the fuel.

The following examples, in which all parts and percentages are by weight unless otherwise indicated, illustrate the invention.

EXAMPLE A

Eight batches of polyisobutylene succinic anhydride (PIBSA) were synthesized by treating 450 MW polyisobutylene (PIB:450 g:1 mole) with maleic anhydride. The quantities of maleic anhydride, the reaction times and temperatures and the catalyst concentration are shown in Table 1. The eight batches of thermal PIBSA were combined to give the final product. Analysis of the product gave:

Saponification number=128.7 mg KOH/g

Free Maleic anhydride<0.1%.

The saponification number indicates that the product has an effective molecular weight of 870. The IR spectrum of the product in the carbonyl region (1900– 1500 wavenumbers or $cm^{-1}$) shows two major peaks at 1863 and 1786 wavenumbers.

TABLE 1

| Maleic Anhydride (moles) | Temperature (°C.) | Reaction Time (hr) | Catalyst (%) |
|---|---|---|---|
| 1.00 | 200 | 8 | 1.00 |
| 0.75 | 220 | 8 | 1.00 |
| 0.75 | 200 | 8 | 0.00 |
| 0.75 | 200 | 12 | 0.00 |
| 1.00 | 200 | 12 | 1.00 |
| 1.00 | 220 | 12 | 0.00 |
| 1.00 | 220 | 8 | 0.00 |
| 0.75 | 220 | 12 | 1.00 |

The catalyst was an alkylaryl sulphonic acid and the percentage is based on the charge of PIB.

EXAMPLE B

A solution of the thermal PIBSA (435 g:0.5 moles) from Example A was dissolved in xylene (200 ml) and slowly added (over 20 hours) to a solution of 1,3-diaminopropane (37 g:0.5 moles) in xylene (150 ml) at 100° C. When the addition was complete the reaction temperature was increased so that the xylene refluxed and water (16 ml:0.89 moles) was collected using a Dean and Stark trap. When removal of water was complete, the xylene was removed by distilling to 180° C. A vacuum was applied to remove the last traces of solvent. The product was a dark viscous oil containing 2.8% nitrogen (Theory=3.08%).

The IR spectrum of the product had four peaks between 1900 and 1500 wavenumbers at 1772(w), 1738(m), 1705(s) and 1674(vs) wavenumbers. Such a spectrum is indicative of the presence of a macrocyclic compound. (In contrast the IR spectrum of the uncyclized additives contains only three peaks in the same region of the spectrum. There is a weak absorption at 1771–72 wavenumbers, a strong absorption at 1701–04 wavenumbers and a medium strength absorption at 1667–70 wavenumbers.)

EXAMPLE C

A solution of thermal PIBSA (435 g:0.5 moles) from Example A was dissolved in xylene (200 ml) and slowly added (over 8.25 hours) to a refluxing solution of 3,3'-imino-bis-propylamine (65.6 g:0.5 moles) in xylene (150 ml). As the reaction proceeded, the water formed (16.5 ml: 0.92 moles) was collected using a Dean and Stark trap. When the addition was complete and no more water was formed the solvent was removed by heating to 180° C. under vacuum. The product was a dark viscous oil containing 4.0% nitrogen (Theory=4.35%).

The IR spectrum of the product has four peaks between 1900 and 1500 wavenumbers at 1771(w), 1732(w), 1702(s) and 1668(s) wavenumbers.

EXAMPLE D

The method of Example C was repeated using N,N'-bis-( 3-aminopropyl)-ethylenediamine (87 g:0.5 moles). The solution of thermal PIBSA was added over 31.5 hr and water (17.5 ml:0.97 moles) was removed using a Dean and Stark trap. After removing the volatile solvent the product (475 g) was a dark viscous oil which contained 5.4% nitrogen (Theory=5.56%).

The IR spectrum of the product has four peaks between 1900 and 1500 wavenumbers at 1772(w), 1737(vs), 1701(vs) and 1669(vs).

EXAMPLE E

A batch of PIBSA was synthesized by reacting 960MW PIB with maleic anhydride at high temperature. The resulting material was diluted with solvent 150 base oil to produce a product with a saponification number of 70.7 mg KOH/g. The saponification number indicates that the product has an effective weight of 1584.

EXAMPLE F

The thermal PIBSA from Example E (500 g:0.32 moles) was added to a solution of 1,3-diaminopropane (24 g:0.32 moles) in toluene (200 ml) at 25° C. The reaction mixture was heated to reflux and then the solvent and water of reaction were removed by distilling to a pot temperature of 170° C. The reaction mixture was held at a temperature of 170° C. for 7 hours. During this time IR spectra of the product were recorded to monitor the formation of the macrocycle.

The product was a dark viscous oil which contained 1.5% nitrogen (Theory=1.75%). The IR spectrum of the product contained four peaks between 1900 and 1500 wavenumbers at 1773(w), 1739(m), 1706(s) and 1675(vs).

EXAMPLE G

The method used in Example F was repeated using thermal PIBSA from Example E (500 g:0.32 moles) and 3,3'-imino-bis-propylamine (42 g:0.32 moles). The product was a dark viscous oil which contained 2.3% nitrogen (Theory= 2.53%). The IR spectrum of the product contained four peaks between 1900 and 1500 wavenumbers at ca. 1770(w), 1730(m), 1702(s) and 1670(s).

EXAMPLE H

The method used in Example F was repeated using thermal PIBSA from Example E (500 g:0.32 moles) and N,N'-bis-( 3-aminopropyl)ethylene diamine (56 g:0.32 moles). The product was a dark viscous oil which contained 3.2% nitrogen (Theory=3.29%). The IR spectrum of the product contained four peaks between 1900 and 1500 wavenumbers at 1771(w), 1731(m), 1702(vs) and 1668(vs).

EXAMPLE I

The method used in Example E was repeated using thermal PIBSA from Example E (500 g:0.32 moles) and N,N'-bis-( 3-aminopropyl)-1,3-propylene diamine (61 g:0.32 moles). The product was a dark viscous oil which contained 3.0% nitrogen (Theory=3.26%). The IR spectrum of the product contained four peaks between 1900 and 1500 wavenumbers at 1770(w), 1735(m), 1699(s) and 1668(vs).

EXAMPLE J

The method used in Example F was repeated using thermal PIBSA from Example E (500 g:0.32 moles) and pentapropylene hexamine (74 g:0.32 moles). The product was a dark viscous oil which contained 3.8% nitrogen (Theory=3.98%). The IR spectrum of the product contained five peaks between 1900 and 1500 wavenumbers at 1769(w), 1732(m), 1701(s), 1668(vs) and 1618(w).

EXAMPLE K

A sample of PIBSA was prepared by reacting a 960MW PIB with maleic anhyride. The resulting PIBSA had a saponification number of 96.3 mg KOH/g, so that the effective molecular weight of the PIBSA was 1163.

The PIBSA (300 g:0.26 moles) was added to a refluxing solution of N,N'-bis-(3-aminopropyl)ethylene diamine (44.8 g:0.26 moles) in toluene (200 ml). When the addition of the PIBSA was complete the solvent and water were removed by distilling the reaction mixture of a temperature of 170° C. The reaction mixture was kept at 170° C. under a stream of nitrogen for seven hours. After that time the IR spectrum of the product showed that no more macrocycle was being formed. The product was a dark viscous oil which contained 3.9% nitrogen (Theory= 4.28%). The IR spectrum of the product contained four peaks between 1900 and 1500 wavenumbers at 1771(w), 1733(m), 1701(s) and 1667(vs).

EXAMPLE L 3500 g of N,N'-bis(3-aminopropyl)ethylene diamine was dissolved in 4750 g of xylene and heated to 80° C. Polyisobutylene succinic anhydride (26910 g), prepared from polyisobutylene of Mn 1000 via the "ene" reaction, was added to the amine solution over a period of 2 hours. The reaction mixture was then heated to reflux for 10 hours and water removed. After refluxing, the solvent was removed by distillation to give a final product with 3.71% nitrogen and a TBN of 97.7 mg KOH/g.

EXAMPLE 1

The additives from Examples F to K were tested in an engine to determine their effect on particulate emissions. The engine used was a 6 cylinder 4 stroke naturally aspirated DI engine with the following specification:

Swept Volume=5958 cc.

Maximum Power=100 KW at 2800 rpm.

Maximum Torque=402 NM at 1400 rpm.

Compression Rate=17.25:1

The fuel used in the tests was a standard UK automotive diesel fuel. A typical analysis was:

Specific Gravity=0.849 kg/liter

Cetane Index=51

Distillation °C.

| | |
|---|---|
| IBP | 162 |
| 20% | 252 |
| 50% | 286 |
| 90% | 338 |
| FBP | 369 |

Sulphur Content=0.23%

Flash Point=69° C.

The additives were compared at 500 ppm using tests run in the following manner:

1. The engine was conditioned prior to testing each additive by running the engine on the test fuel at 75% speed and 75% load for 12 hours.
2. The emissions from the engine were then measured using a standard ECE R49 thirteen mode test.

The test consists of thirteen modes, i.e., engine speed and load combinations, each of 6 minutes duration, run consecutively over a total test time of 78 minutes, emission measurements being made in each mode. The results, obtained from the individual mode results following the procedure laid down in the R49 test, are shown in Table 2.

TABLE 2

| Additive | Particulate (g/KWhr) |
|---|---|
| nil | 1.08 |
| Example F | 0.80 |
| Example G | 0.80 |
| Example H | 0.86 |
| Example I | 0.88 |
| Example J | 0.93 |
| Example K | 0.87 |

In the test using the fuel with no additive, the running of the engine for 12 hours in stage 1 ensures the formation of injector and other fuel-related deposits for the test in stage 2 and allows the particulate emission level to reach a stable level. In the tests of the fuels containing an additive, stage 1 removes any pre-existing deposits, or maintains the engine in a clean state, for the test in stage 2. Accordingly this test measures two effects of the additive, first, the reduction in particulate emission resulting from the operation of a cleaner engine and, second, the direct effect of the improved quality of combustion resulting from the presence of the additive in the fuel burning in the combustion chamber.

It is clear from the results in Table 2 that all the additives tested reduce the mass of particulates emitted by the engine during the R49 test. The reduction varies from 13.9% to 25.9%. It is apparent that the size of the macrocyclic ring affects performance. The small ring macrocyclic compounds (Examples F and G) are more effective than the large ring macrocyclic compounds (Examples H to K).

EXAMPLE 2

The engine and fuel of Example 1 were used to determine the effect of additive concentration on reduction of particulates. The additive from Example L was tested at different concentrations. The tests were run in the following manner:

1. The engine was warmed up over a period of 90 minutes to full speed and full load.
2. A stabilizing test was run using untreated fuel.
3. A test was run on the untreated fuel and emission data were collected.
4. A test was run on the fuel treated with the additive and emission data were collected.
5. Stages 3 and 4 were repeated using different concentrations of the additive.

The emissions measured included the quantity of particulate present in the exhaust. Table 1 shows the % reduction of particulate between stages 4 and 3 with different concentrations of additive.

TABLE 3

| ADDITIVE (ppm) | REDUCTION IN PARTICULATE (%) |
|---|---|
| 0 | 0.0 |
| 125 | 2.6 |
| 250 | 5.1 |
| 500 | 10.5 |
| 1000 | 20.3 |

The effect of the additive in reducing particulate is apparent.

Stages 2 and 3 of the test cause injector nozzle fouling, and accordingly in stage 4 the reductions in particulate emissions when additive-containing fuels are used, compared with those resulting in stage 4 for the fuel with no additive, are predominantly attributable to the direct effect alone, since insufficient time (78 minutes) elapses in stage 4 to clean the engine significantly compared with Example 1.

It will be noted that the particulate reduction when 500 ppm of the additive are employed is 10.5%. When the structurally closely similar products of Examples I and K were tested in Example 1, the reductions noted were 18.5% and 19.4% respectively, a comparison of these two Examples indicating that approximately half the total reduction in emissions observed in the procedure of Example 1 is attributable to the direct effect.

EXAMPLE 3

The additive from Example L was tested alone and in combination with a cetane improver. The cetane improver was an alkyl nitrate made from a $C_8$ alcohol. The experiments were carried out using the standard ECE R49 thirteen mode test. The tests were run using a VOLVO TD121/122F engine. The fuel used was similar to that used in Example 1.

The weight of particulate formed in each stage of the test was measured by collecting the particulate on a pre-weighed filter paper. The overall amount of particulate from the 13 modes was determined using the standard weighting factors for each mode. The results are shown in Table 4.

TABLE 4

The Effect of a Macrocyclic Polyamine with and without a Cetane Improver on Particulate Emissions

| Macrocyclic Polyamine (ppm) | Cetane Improver (ppm) | Particulate (g/KWhr) |
|---|---|---|
| 0 | 0 | 0.243 |
| 500 | 0 | 0.226 |
| 150 | 750 | 0.131 |

It can be seen that 500ppm of the macrocyclic polyamine alone reduces the weight of particulate by 7%. Reducing the amount of polyamine to 150 ppm and using cetane improver (750 ppm) reduces the particulate by 46%.

EXAMPLE 4

The additive from Example L was tested alone and in combination with the cetane improver used in Example 3 using the standard ECE R49 thirteen mode test in a PERKINS PHASER 180 Ti engine. The fuel used was similar to that used in Example 1. The weight of particulate formed in each stage of the test was measured as in Example 3. The results are shown in Table 5.

TABLE 5

| Macrocyclic Polyamine (ppm) | Cetane Improver (ppm) | Particulate (g/KWhr) |
|---|---|---|
| 0 | 0 | 0.911 |
| 500 | 0 | 0.730 |
| 150 | 750 | 0.696 |

It can be seen that 500 ppm of the macrocyclic dispersant alone reduces the amount of particulate by 20%. Reducing the amount of dispersant to 150 ppm and using cetane improver (750 ppm) reduces the particulate by 24%.

We claim:

1. A method of reducing particulate emission from a diesel engine which comprises supplying to the engine a fuel oil containing 0.005 to 0.2% by weight of a composition consisting essentially of Z an oil soluble compound of the formula:

(I)

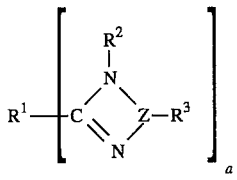

wherein $R^1$, $R^2$ and $R^3$ may be the same or different and are independently hydrogen or a hydrocarbyl substituent having from 2 to 600 carbon atoms, or a keto, halo, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together form a hydrocarbylene substituent having 4 to 600 carbon atoms or a keto, halo, hydroxy, nitro, cyano or alkoxy derivative thereof, provided that $R^1$ and $R^2$ together with the carbon atom which forms the C—$R^1$ bond with $R^1$ and the nitrogen atom which forms the N—$R^2$ bond with $R^2$ form a ring having at least 5 members, wherein Z represents $$—R^{10}[NR^{11}(R^{10})]_c—$$

or $$—[R^{10}R^{11}N]_dR^{10}[NR^{11}R^{10}]_e$$

wherein each $R^{10}$, which may be the same or different, represents an alkylene group having from 1 to 5 carbon atoms in its chain, each $R^{11}$, which may be the same or different, represents a hydrogen atom or a hydrocarbyl group, and c is from 0 to 6, d is from 1 to 4, e is from 1 to 4, provided that d+e is at most 5, a is from 1 to 150, or a post-treatment derivative of such a compound and (b) a cetane improver being an organic nitrate having aliphatic or cycloaliphatic groups containing up to 30 carbon atoms, the organic nitrate being present in an amount of from 0.005 to 0.5% by weight of the fuel whereby the particulate emissions of the engine are reduced.

2. The method of claim 1, wherein the compound is a compound of the formula I and is of the formula:

III

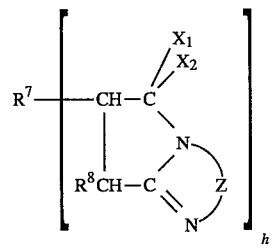

IV

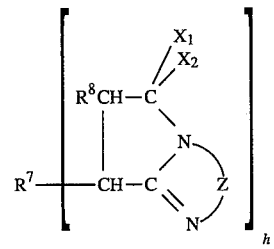

V

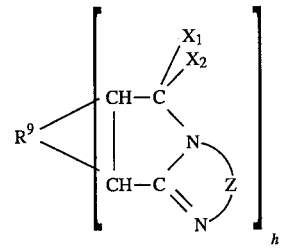

wherein $R^7$ is hydrogen or a hydrocarbyl substituent having from 1 to 600 carbon atoms, $R^8$ is hydrogen or a $C^1$ to $C^{12}$ hydrocarbyl substituent, and, if there is more than one $R^8$ in a compound, they may be the same or different, $R^9$ is a hydrocarbylene substituent having from 2 to 600 carbon atoms, two of which carbon atoms are bonded to the α-carbon atoms of the succinic anhydride based ring, $X_1$ represents hydrogen or an alkyl group having from to 12 carbon atoms, $X_2$ represents hydrogen, an alkyl group having from 1 to 12 carbon atoms, a hydroxy group, or an alkoxy group having from 1 to 12 carbon atoms, or $X_1$ and $X_2$ may together represent an oxygen or sulfur atom, Z has a meaning given in claim 1, and h is from 1 to 20, or a post-treatment derivative of such a compound.

3. The method of claim 2, wherein the compound is an oil soluble compound of the formula

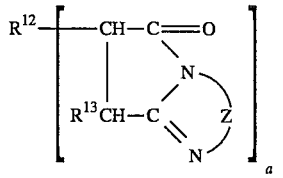

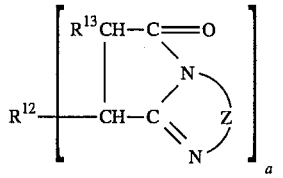

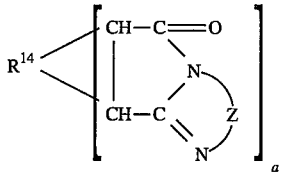

or mixtures of two or more such compounds, wherein $R^{12}$ is a hydrocarbyl substituent having from 2 to 400 carbon atoms, $R^{13}$ is hydrogen or a $C_1$ to $C_{12}$ hydrocarbon substituent, and, if there are more than one $R^{13}$ in a compound, they may be the same or different, $R^{14}$ is a hydrocarbylene substituent having from 4 to 400 carbon atoms, two of which carbon atoms are bonded to the α-carbon atoms of the succinic anhydride based ring and —Z— represents $—CH_2CH_2CH_2—$; $—(CH_2CH_2CH_2NH)_nCH_2CH_2CH—$, where n is 1 to 6, or $—(CH_2CH_2CH_2NH)_m(CH_2)_p(NHCH_2CH_2CH_2)_q—$ where m and q are each at least 1 and m+q=2 to 5, p is 1 to 5, and a is 1 to 20, or a post-treatment derivative of such a compound.

4. The method of claims 1, 2 or 3 wherein at least one of R1, R2 and $R^{3,}$ or wherein at least one of R7 and R9, or wherein at least one of R12 or R14 is derived from a C2 to C5 olefin polymer.

5. The method of claim 4, wherein the polymer is polyisobutylene.

6. The method of claim 5, wherein the polymer contains from 10 to 200 carbon atoms.

7. The method of claim 6, wherein the polymer contains from 20 to 100 carbon atoms.

8. The method of claims 1, 2 or 3 or 7, wherein —Z— represents $—(CH_2)_3NH(CH_2)_3—$, $—(CH_2)_3NHCH_2CH_2NH(CH_2)_3—$, or $—(CH_2)_3—$.

9. The method of claim 8, wherein the oil soluble compound has been prepared by the reaction of a hydrocarbyl reactant and a polyamine reactant in a mole ratio of from 0.2:1 to 5:1.

10. The method of claim 9, wherein the mole ratio is 0.5:1 to 2:1.

11. The method of claims 1, 2 or 3, 5–7 or 8–10 wherein the oil soluble compound is used in the form of a post-treatment derivative.

12. The method of claim 11 wherein the post-treatment derivative is formed by post-treatment of the oil soluble compound with boron oxide, boron oxide hydrate, a boron halide, a boron acid, sulfur, a sulfur chloride a phosphorus oxide or sulfide, a carboxylic acid or anhydride, an acyl halide, an epoxide, an episulphide or acrylonitrile.

13. The method of claim 12, wherein the post-treatment derivative is formed by post-treatment with polyisobutylene succinic anhydride.

* * * * *

UNITED STATES PATENT AND TRADEMARK OFFICE

CERTIFICATE OF CORRECTION

PATENT NO. : 5,478,367

DATED : December 26, 1995

INVENTOR(S) : M.D. Sexton, A.K. Smith, A Gutierrez and S. Brois

It is certified that error appears in the above-indentified patent and that said Letters Patent is hereby corrected as shown below:

Col. 13 ;

In claim 1, line 48, delete "Z".

Col. 16;

In claim 8, line 20, change "7" to --5 to 7--.

Signed and Sealed this

Eleventh Day of June, 1996

*Attest:*

Bruce Lehman

BRUCE LEHMAN

*Attesting Officer*

*Commissioner of Patents and Trademarks*